US006445266B1

(12) United States Patent
Nagatomi et al.

(10) Patent No.: US 6,445,266 B1
(45) Date of Patent: Sep. 3, 2002

(54) MULTILAYER FILTER HAVING VARIED DIELECTRIC CONSTANT REGIONS

(75) Inventors: Yoshitaka Nagatomi, Suita; Naoki Yuda, Hirakata; Toshio Ishizaki, Kobe; Shoichi Kitazawa, Nishinomiya; Toru Yamada, Katano, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/041,262

(22) Filed: Oct. 25, 2001

Related U.S. Application Data

(62) Division of application No. 09/707,307, filed on Nov. 7, 2000, now Pat. No. 6,359,531, which is a division of application No. 09/142,350, filed as application No. PCT/JP97/04906 on Dec. 26, 1997, now Pat. No. 6,177,853.

(30) Foreign Application Priority Data

Jan. 7, 1997 (JP) ..... 9-502
Jan. 17, 1997 (JP) ..... 9-6000

(51) Int. Cl.[7] ..... H01P 1/203
(52) U.S. Cl. ..... 333/204; 333/219
(58) Field of Search ..... 333/204, 202, 333/219, 175, 185, 161

(56) References Cited

U.S. PATENT DOCUMENTS

| | | | | |
|---|---|---|---|---|
| 5,132,651 | A | 7/1992 | Ishikawa et al. | 333/202 |
| 5,291,160 | A | 3/1994 | Ishikawa et al. | 333/202 |
| 5,323,128 | A | 6/1994 | Ishizaki et al. | 333/204 |
| 5,396,201 | A | 3/1995 | Ishizaki et al. | 333/204 |
| 5,497,130 | A | 3/1996 | Hirai et al. | 333/204 |
| 5,719,539 | A | 2/1998 | Ishizaki et al. | 333/204 |
| 6,222,430 | B1 * | 4/2001 | Horie et al. | 333/204 |

FOREIGN PATENT DOCUMENTS

| | | |
|---|---|---|
| JP | 1-297901 | 12/1989 |
| JP | 3-14310 | 1/1991 |
| JP | 3-16301 | 1/1991 |
| JP | 3-213009 | 9/1991 |
| JP | 5-95202 | 4/1993 |
| JP | 5-114801 | 5/1993 |
| JP | 7-226602 | 8/1995 |
| JP | 8-8605 | 1/1996 |
| JP | 8-56102 | 2/1996 |
| JP | 8-237003 | 9/1996 |
| JP | 8-298402 | 11/1996 |
| JP | 8-321738 | 12/1996 |

OTHER PUBLICATIONS

Search report corresponding to application No. PCT/JP97/04906 dated Apr. 14, 1998.

* cited by examiner

*Primary Examiner*—Robert Pascal
*Assistant Examiner*—Stephen E. Jones
(74) *Attorney, Agent, or Firm*—RatnerPrestia

(57) ABSTRACT

A small multilayer filter, in which a phase shifter may be constituted without increasing overall size of the filter. The overall size may be reduced without deteriorating the characteristics. Above the open end of a plurality of strip lines 4A provided on a dielectric layer 4, a coupling sector 3A of input/output pattern is placed to face it with a dielectric layer 3 interposed. An inductance L1, L2 is formed by connecting a side electrode 7A, 7B with a continuity sector 3B of input/output pattern; and said side electrode 7A, 7B with an input electrode 8A, output electrode 8B, respectively, by means of an electrode pattern 5A.

3 Claims, 12 Drawing Sheets

MULTILAYER FILTER HAVING VARIED DIELECTRIC CONSTANT REGIONS

CROSS-RELATED APPLICATIONS

This application is a Divisional of U.S. patent application Ser. No. 09/707,307, filed Nov. 7, 2000, now U.S. Pat. No. 6,359,531, which is a Divisional of U.S. Pat. application Ser. No. 09/142,350 filed Sep. 8, 1998, now U.S. Pat. No. 6,177,853, which is a U.S. National Phase Application of PCT/JP97/04906.

TECHNICAL FIELD

The present invention relates to a multilayer filter for use in a high frequency circuit of a mobile communication apparatus such as a portable telephone.

BACKGROUND ART

When connecting two or more filters, each having different band pass region, to a conventional multilayer filter, a phase shifter has been provided as an external device at the respective input/output ports in order not to affect each other's band pass region.

Further, as shown in FIG. 20, two band pass filters 61, 62 have been employed for matching the impedance so as the two band pass regions, viz. a low band pass region 31 and a high band pass region 32 of FIG. 19, do not give influence to each other.

However, if each of the input/output terminals of the respective filters is connected with an external phase shifter, the overall size of an entire filter becomes large, rendering it unsuitable for use in a mobile communication apparatus where the small-size, light-weight and thin-shape are the essential requirements.

In a configuration where two band pass filters 61, 62 are provided as shown in FIG. 20, the designing consideration is focussed only on the impedance matching between the low band pass region 31 and the high band pass region 32. Therefore, the amount of attenuation remains insufficient with respect to a band region 33 locating between the low band pass region 31 and the high band pass region 32. Thus it deteriorated the characteristics of high frequency circuit in a mobile communication apparatus.

The present invention addresses the above described drawbacks, and offers a small multilayer filter with which the amount of attenuation is sufficient in a region other than band pass region, while the insertion loss characteristic caused as a result of insertion of two or more band pass regions is not deteriorated.

DISCLOSURE OF THE INVENTION

The invented multilayer filter comprises a plurality of strip lines provided on a dielectric layer, a side electrode connected with an end of input pattern and output pattern which patterns are coupled with an open end of the strip line via dielectric layer, and an electrode pattern connecting said side electrode with input electrode and output electrode. With the above described structure, a phase shifter of a filter may be constituted within the filter, making the filter small in size.

In the invented multilayer filter, an attenuation peak is placed in a region other than the band pass region. Therefore, a sufficient amount of attenuation is ensured outside the band pass region without deteriorating the insertion loss characteristic of the band pass region.

BEST MODE FOR CARRYING OUT THE INVENTION (Exemplary Embodiment 1)

Figure 1:
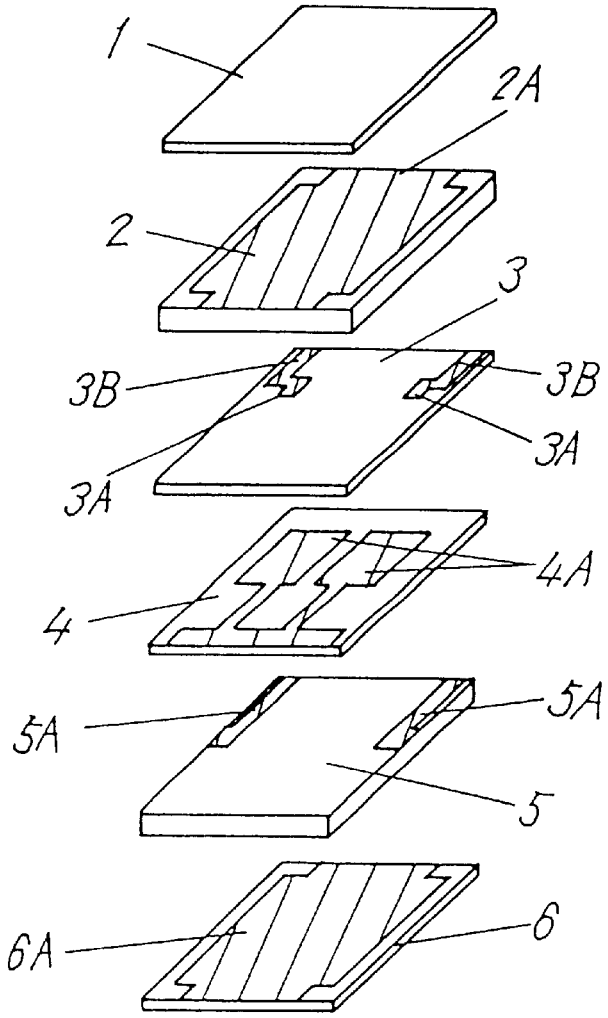
FIG. 1 is an exploded perspective view of a multilayer filter in accordance with a first exemplary embodiment of the present invention.
Figure 2:
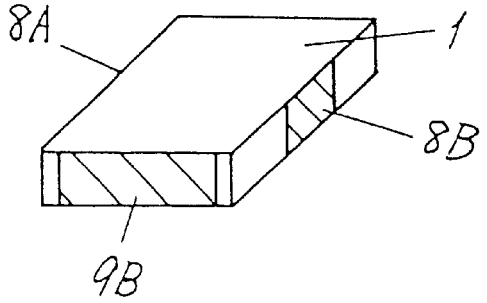
FIG. 2 is a perspective view of the multilayer filter.
Figure 3:
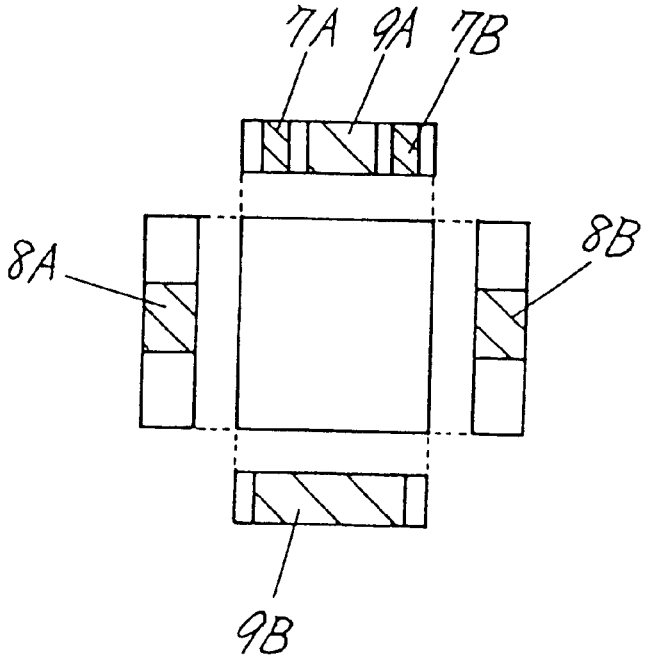
FIG. 3 is an unfolded view of the multilayer filter used to show its outside terminal.
Figure 4:
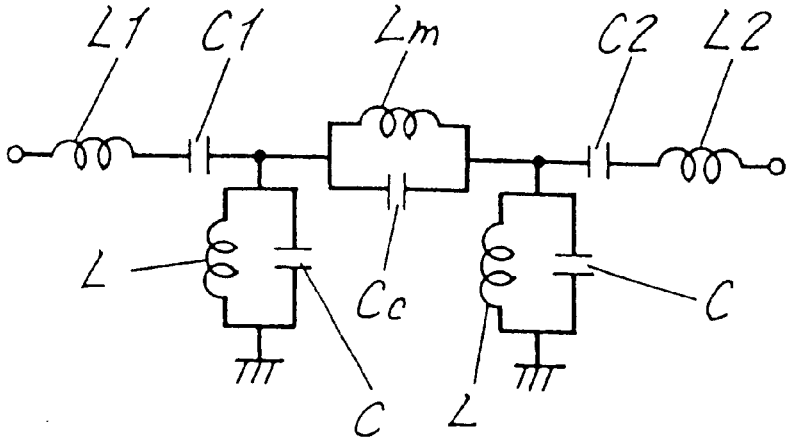
FIG. 4 is an equivalent circuit diagram of the multilayer filter.

FIG. 1 is an exploded perspective view of a multilayer filter in accordance with a first exemplary embodiment of the present invention, FIG. 2 is a perspective view of the multilayer filter used to show its whole aspect, FIG. 3 is an unfolded view of the multilayer filter used to show its outside terminal, and FIG. 4 is an equivalent circuit diagram of the multilayer filter. Namely, the filter has been formed of six layers of dielectric 1–6 stacked one on the other, with shield patterns 2A, 6A provided on the upper surfaces of dielectric layers 2, 6, respectively. On the upper surface of dielectric layer 3 is a coupling sector 3A of input/output pattern, and a strip line 4A is provided on the upper surface of dielectric layer 4. The coupling sector 3A of input/output pattern is facing to the strip line 4A.

A continuity sector 3B of input/output pattern is connected to a side electrode 7A, 7B, as shown in FIG. 1 and 3 with the width of a channel running in a direction perpendicular to the length direction of the strip line reduced. The side electrode 7A, 7B is connected, as shown in FIG. 3, with an input/output electrode 8A, 8B via an electrode pattern 5A.

With the above described constitution, an inductance L1, L2 is realized as shown in FIG. 4 so as the input impedance goes higher in a frequency range higher than a band pass region. In this way, a filter of higher band pass region may be connected to without employing an external device.

Figure 5:
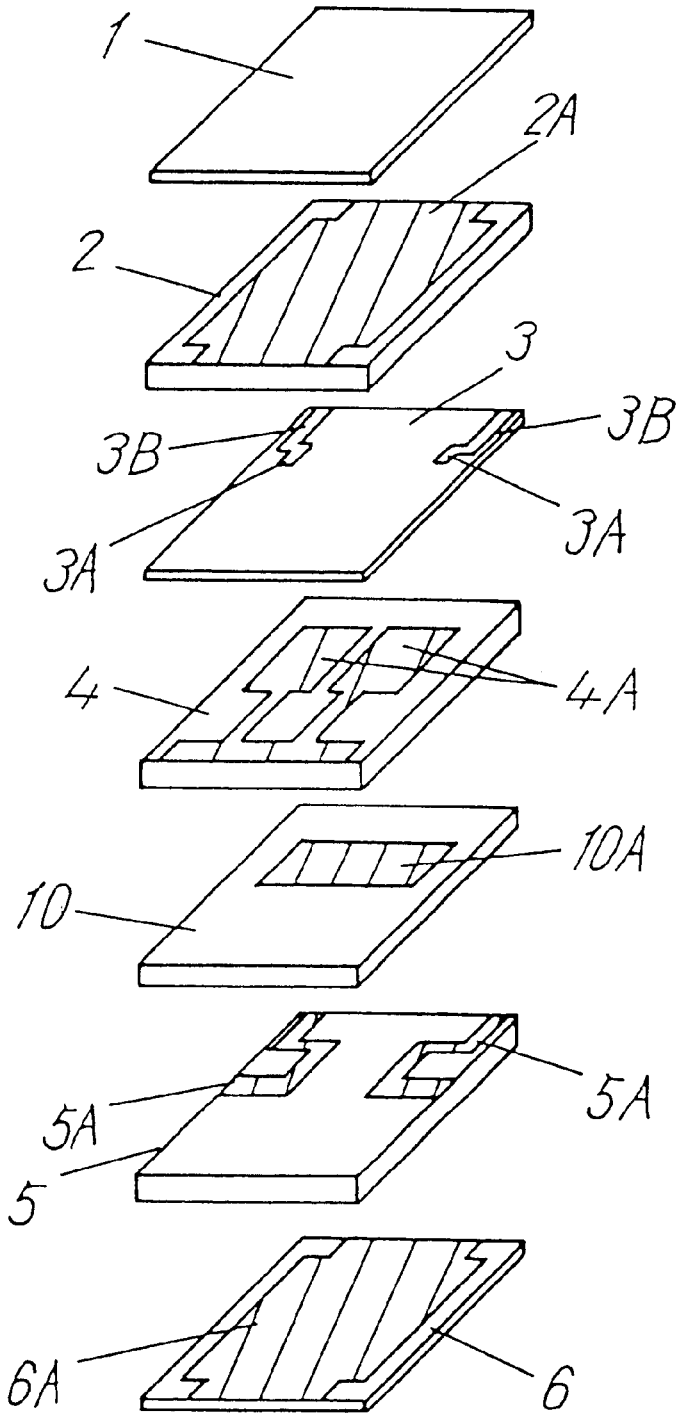
FIG. 5 is an exploded perspective view of a multilayer filter in accordance with another application of the first exemplary embodiment.

In order not to reduce the characteristic impedance to an increased resistance component, it is preferred that the electrode pattern 5A be formed in a layer which is closer to the strip line 4A than to the shield pattern 6A. The electrode pattern 5A should preferably be formed in an area not facing the strip line 4A, for the reason of avoiding electromagnetic coupling. In a case where the electrode pattern 5A is placed facing to the strip line 4A, as shown in FIG. 5, for making the overall size small, it is preferred that a capacitor pattern 10A be provided between the electrode pattern 5A and the strip line 4A in order to prevent a possible influence on the filter characteristic.

As a result of the above, a capacitor C1, C2 is formed, as shown in FIG. 4, between the strip line 4A and the coupling sector 3A of input/output pattern (the right and the left), and a filter is constituted with the L, C and Lm, Cc formed by the strip line 4A. The inductance L1, L2 shown in FIG. 4 prevents an influence on the impedance of high frequency region with a filter constituted among the continuity sector 3B of input/output pattern, the side electrode 7A, 7B, and the electrode pattern SA shown in FIG. 1 and FIG. 3, by which it turns out possible to provide a frequency region higher than the band pass region of filter with a high impedance.

(Exemplary Embodiment 2)

Figure 6:
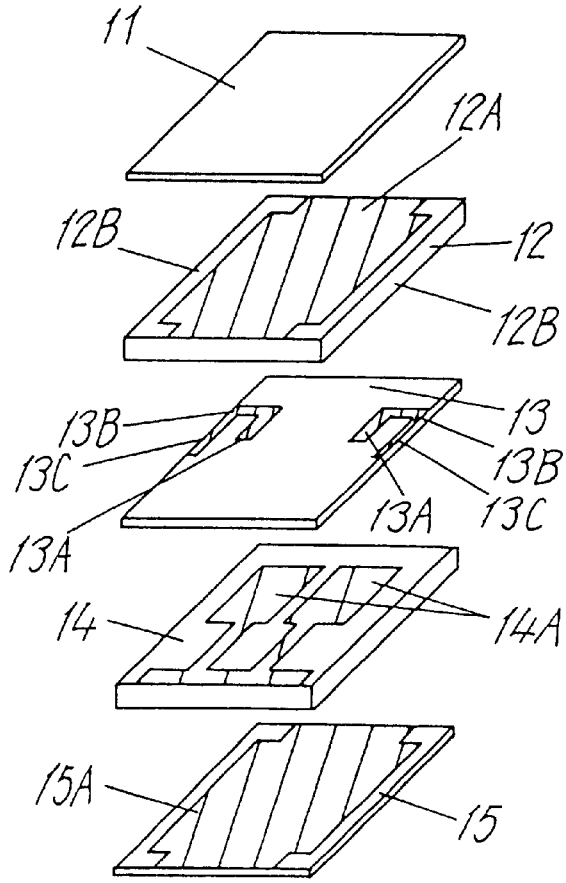
FIG. 6 is an exploded perspective view of a multilayer filter in accordance with a second exemplary embodiment of the present invention.
Figure 7:
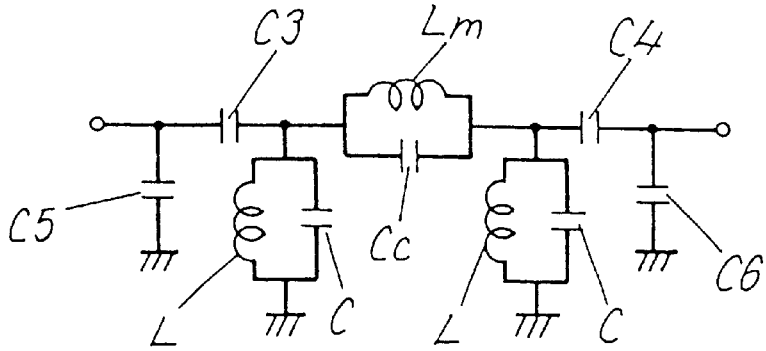
FIG. 7 is an equivalent circuit diagram of the multilayer filter.

FIG. 6 is an exploded perspective view of a multilayer filter in accordance with a second exemplary embodiment of the present invention, FIG. 7 is an equivalent circuit diagram of the multilayer filter. Namely, the filter has been formed of five layers of dielectric 11–15 stacked one on the other, with shield patterns 12A, 15A provided on the upper surfaces of dielectric layers 12, 15, respectively. On the upper surface of dielectric layer 13, a coupling sector 13A of input/output pattern, a continuity sector 13B of input/output pattern, and an outlet sector 13C of input/output pattern are provided, and a strip line 14A is provided on the upper surface of dielectric layer 14. The coupling sector 13A of input/output pattern is facing to the strip line 14A. A low dielectric constant region 12B having a dielectric constant lower than that of dielectric layer 12 is provided between the continuity sector 13B of input/output pattern and the shield pattern 12A.

Figure 8:
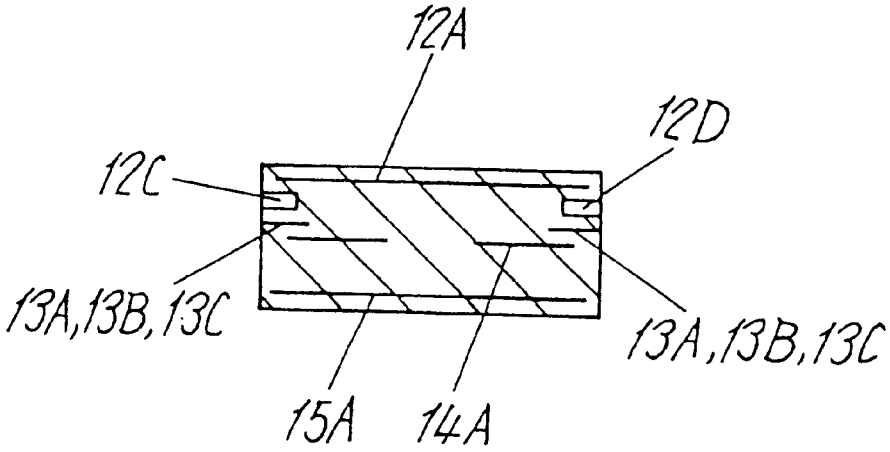
FIG. 8 is a cross sectional view of a multilayer filter in accordance with another application of the second exemplary embodiment.
Figure 9:
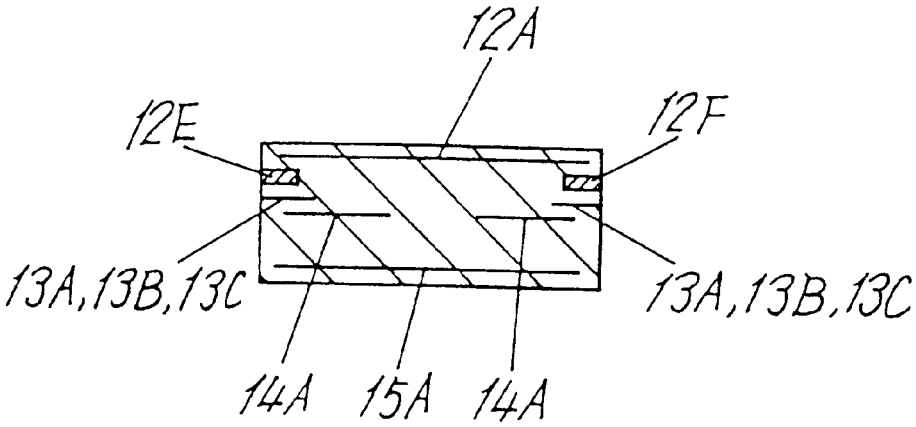
FIG. 9 is a cross sectional view of a multilayer filter in accordance with still another application of the second exemplary embodiment.

With the above described constitution, the grounding capacitance C5, C6, which being a parasitic element, is made small, and a capacitance C3, C4 is formed as shown in FIG. 7 so as input impedance is higher in a frequency range lower than band pass region. In this way, a filter having a lower band pass region may be connected without employing an external device. The low dielectric constant region 12B may be formed by an empty space 12C, 12D shown in FIG. 8, or with a material 12E, 12F shown in FIG. 9 having a dielectric constant lower than that of the dielectric layer 12.

(Exemplary Embodiment 3)

Figure 10:
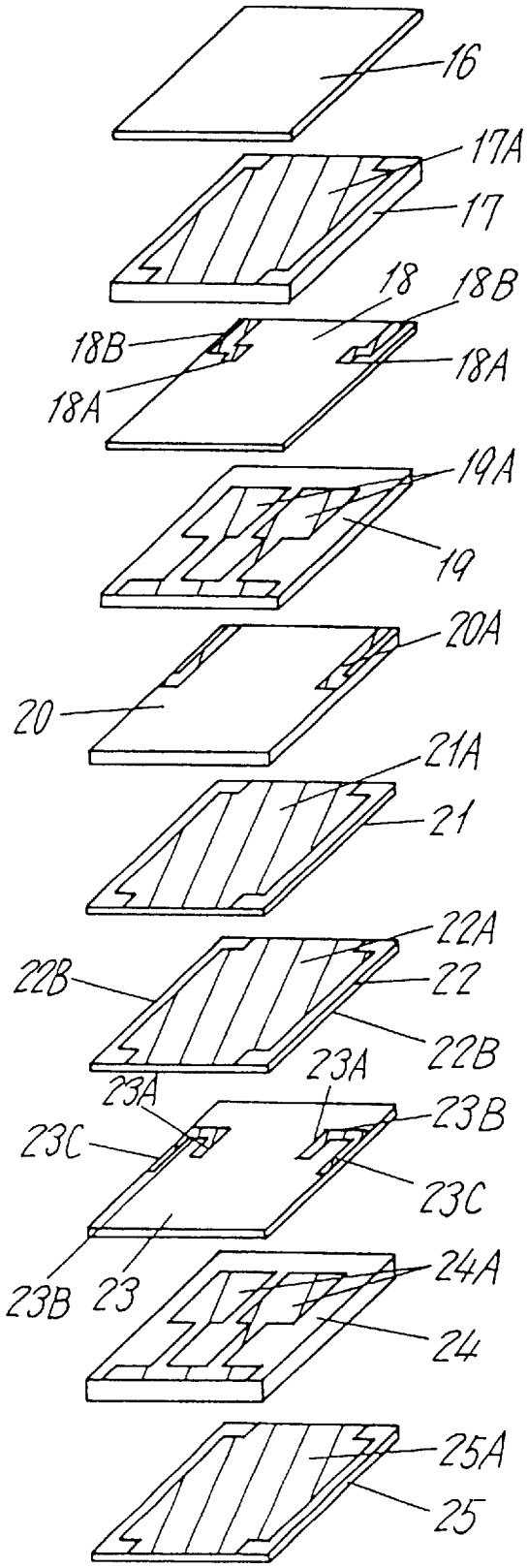
FIG. 10 is an exploded perspective view of a multilayer filter in accordance with a third exemplary embodiment of the present invention.
Figure 11:
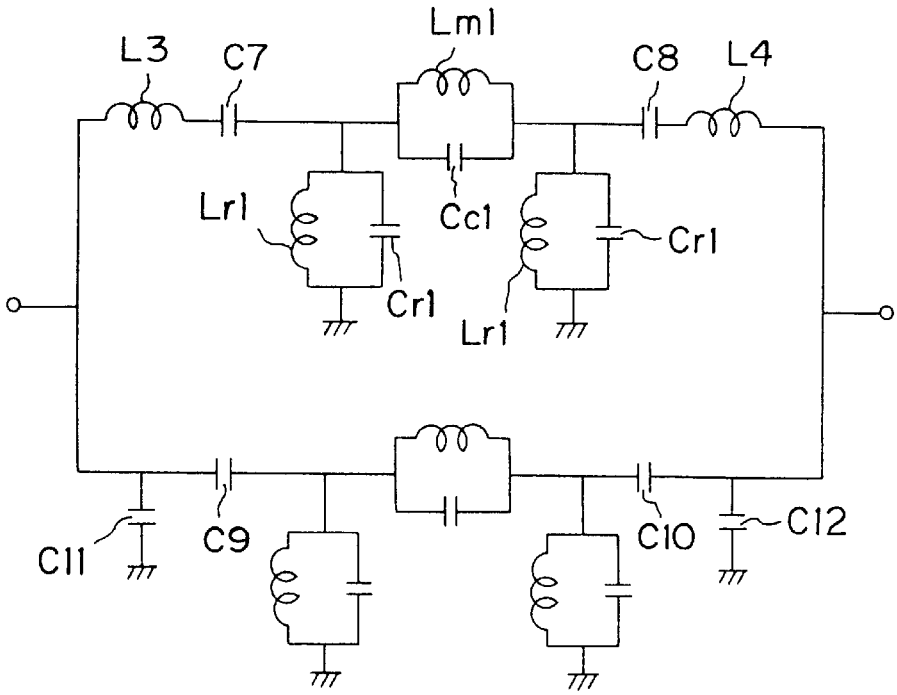
FIG. 11 is an equivalent circuit diagram of the multilayer filter.

FIG. 10 is an exploded perspective view of a multilayer filter in accordance with a third exemplary embodiment of the present invention, and FIG. 11 is an equivalent circuit diagram of the multilayer filter. Namely, the filter has been formed of ten layers of dielectric 16–25 stacked one on the other, with shield patterns 17A, 21A, 22A, 25A provided on the upper surfaces of dielectric layers 17, 21, 22, 25, respectively. On the upper surface of dielectric layer 18, a coupling sector 18A of input/output pattern is provided, and a strip line 19A is provided on the upper surface of dielectric layer 19. The coupling sector 18A of input/output pattern is facing to the strip line 19A. The continuity sector 18B of input/output pattern is connected to the side electrode 7A, 7B, as shown in FIG. 3. The side electrode 7A, 7B is connected, as shown in FIG. 3, to the input/output electrode 8A, 8B via an electrode pattern 20A.

As a result of the above, a capacitor C7, C8 is formed, as shown in FIG. 11, between the strip line 19A and the coupling sector 18A of input/output pattern (the right and the left), and a filter is constituted with the Lr1, Cr1 and Lm1, Cc1 formed by the strip line 19A. The inductance L3, L4 of FIG. 11 is realized by the continuity sector 18B of input/output pattern, the side electrode 7A, 7B, and the electrode pattern 20A of FIG. 10. Thus the input impedance is made high in a frequency range higher than the band pass region, and a filter having a higher band pass region may be connected without employing an external device.

On the upper surface of dielectric layer 23, a coupling sector 23A of input/output pattern, a continuity sector 23B of input/output pattern, and an outlet sector 23C of input/output pattern are provided, and a strip line 24A is provided on the upper surface of dielectric layer 24. The coupling sector 23A of input/output pattern is facing to the strip line 24A. A low dielectric constant region 22B having a dielectric constant lower than that of dielectric layer 22 is provided between the continuity sector 23B of input/output pattern and the shield pattern 22A.

Figure 12:
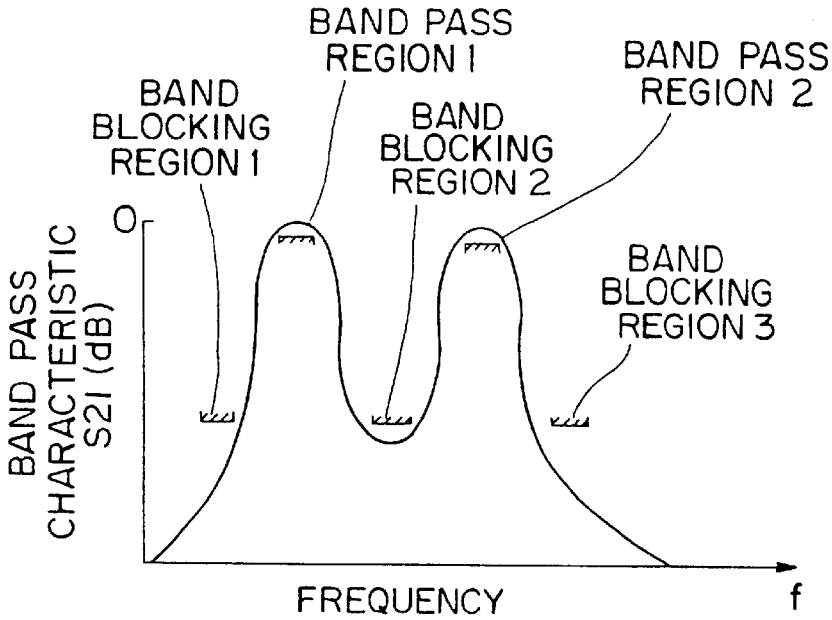
FIG. 12 is a frequency characteristic chart of the multilayer filter.
Figure 13:
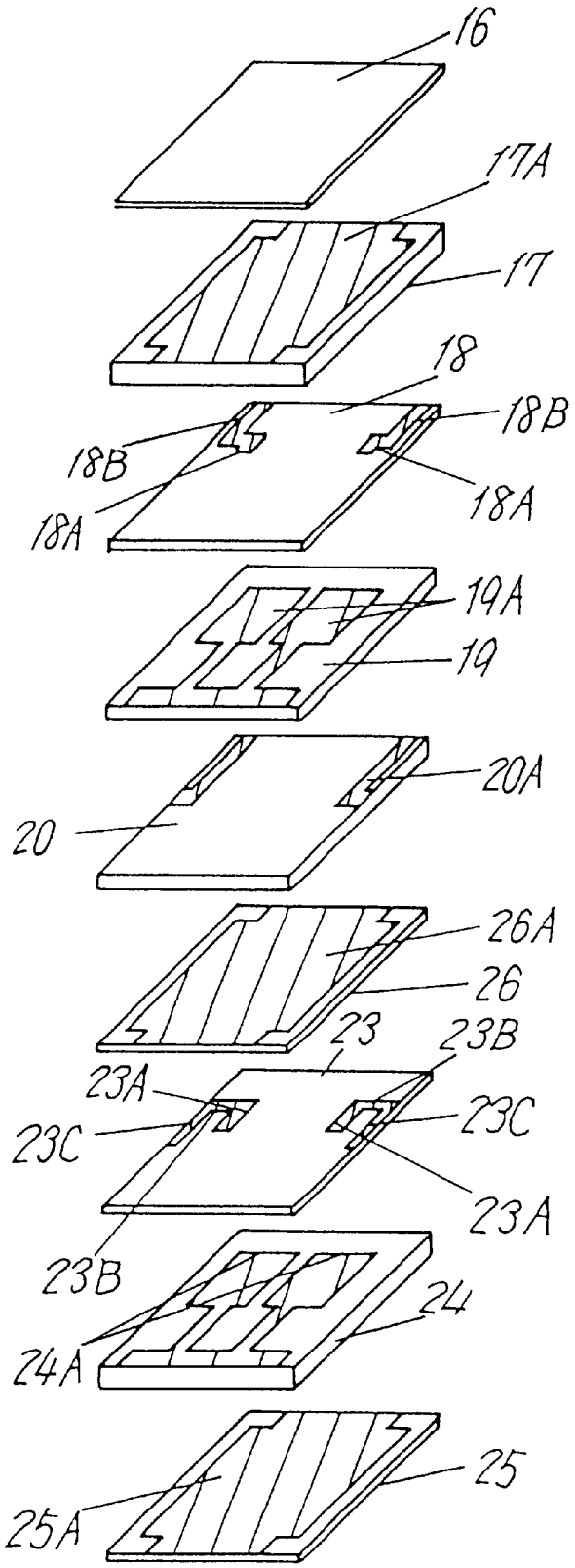
FIG. 13 is an exploded perspective view of a multilayer filter in accordance with another application of the third exemplary embodiment.

With the above described constitution, the grounding capacitance C11, C12, which being a parasitic element, is made small, and a capacitance C9, C10 is formed as shown in FIG. 11 so as input impedance is high in a frequency range lower than the band pass region. In this way, a filter having a lower band pass region may be connected without employing an external device. Thus, a filter of two band pass regions with a single input and a single output may be implemented; whose frequency characteristic is shown in FIG. 12. Furthermore, the shield pattern 21A and the shield pattern 22A, which are the plural shield patterns facing each other via dielectric layer, may be integrated into one shield pattern 26A as shown in FIG. 13. This may result in a reduced number of layers, in favor of reduced dimensions of a filter.

(Exemplary Embodiment 4)

Figure 14:
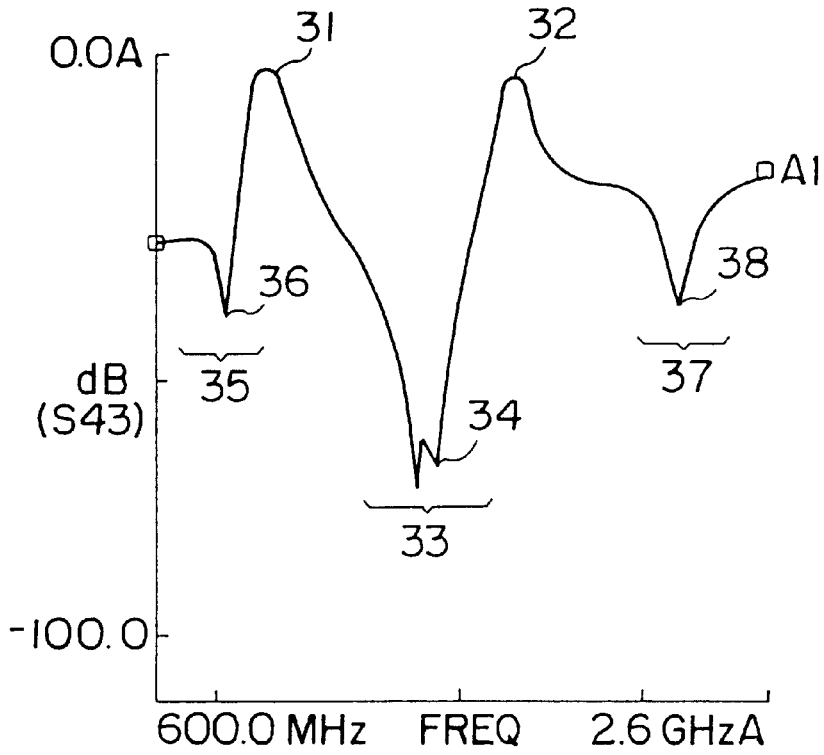
FIG. 14 is a chart used to show band pass characteristic of a multilayer filter in accordance with a fourth exemplary embodiment.
Figure 15:
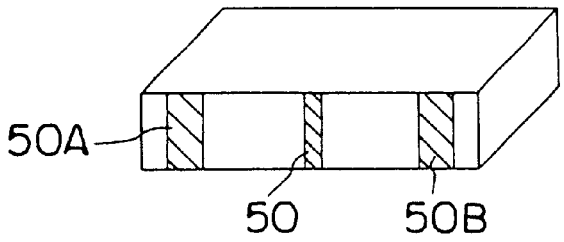
FIG. 15 is a perspective view of a multilayer filter of the fourth exemplary embodiment.
Figure 16:
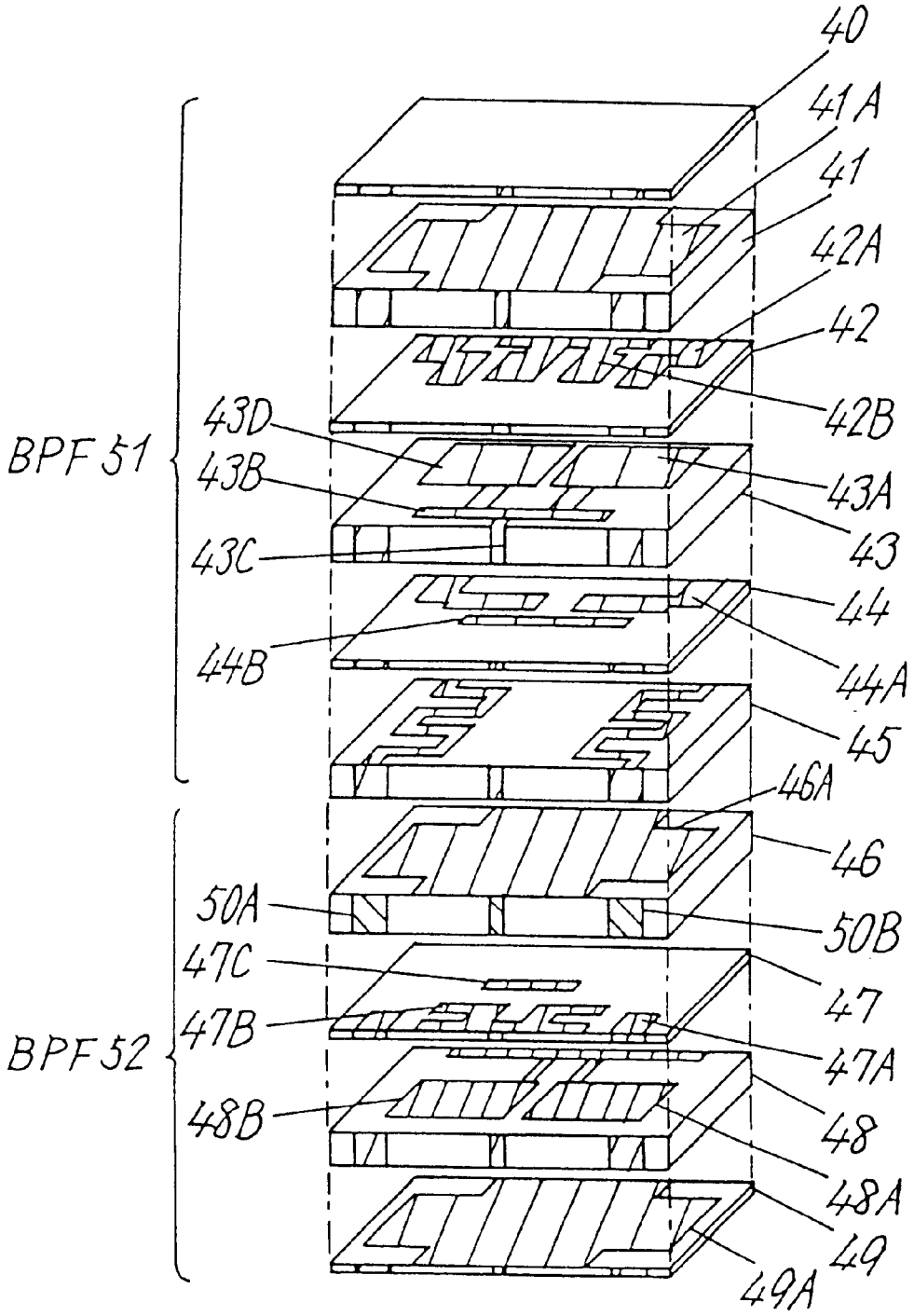
FIG. 16 is an exploded perspective view of a multilayer filter in accordance with the fourth exemplary embodiment.
Figure 17:
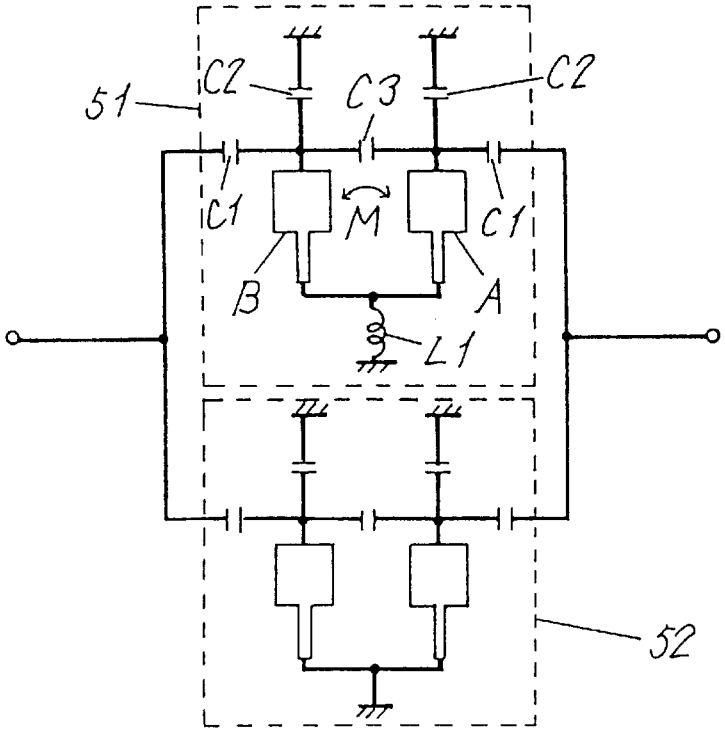
FIG. 17 is an equivalent circuit diagram of the multilayer filter.

FIG. 14 is a chart used to show band pass characteristics of a multilayer filter in accordance with a fourth exemplary embodiment, FIG. 15 is a perspective view of the multilayer filter, FIG. 16 is an exploded perspective view of the filter, FIG. 17 is its equivalent circuit diagram.

A filter of the present embodiment is formed of ten layers of dielectric 40–49 stacked one on the other, as shown in FIG. 16, with shield patterns 41A, 46A, 49A provided on the upper surfaces of dielectric layers 41, 46, 49, respectively. On the upper surface of dielectric layer 42 are an input/output capacitance pattern 42A and a loading capacitance pattern 42B, and an input/output capacitance pattern 44A and a coupling capacitance pattern 44B are provided on the upper surface of dielectric layer 44. On the upper surface of dielectric layer 43, a strip line 43A, 43D is provided forming a resonator A, B. At both sides of the multilayer filter, a side electrode 50A, 50B is provided connected with the input/output capacitance pattern 42A, 44A, respectively.

The input/output capacitance patterns 42A and 44A are facing to each other with strip line 43A, 43D, dielectric layer 42 and dielectric layer 43 interposing between the two; an input/output capacitor C1 shown in the equivalent circuit of FIG. 17 is thus formed. In a same manner, the loading capacitance pattern 42B and the strip line 43A, 43D are facing to each other to form a loading capacitor C2 with dielectric layer 42 interposing in between. Further, the coupling capacitance pattern 44B and the strip line 43A, 43D are facing to each other to form an interlayer capacitor C3 with dielectric layer 43 interposing in between. The strip lines 43A and 43D are line-connected to form an electromagnetic coupling M.

The input/output capacitance patterns 42A and 44A, the strip line 43A, 43D, the loading capacitance pattern 42B, and the coupling capacitance pattern 44B form a band pass filter 51 of low band pass region 31. In a same manner, the input/output capacitance pattern 47A, the loading capacitance pattern 47B, coupling capacitance pattern 47C, each provided on dielectric layer 47, and the strip line 48A, 48B provided on dielectric layer 48 form a band pass filter 52 of high band pass region 32.

FIG. 14 shows band pass characteristics of a filter of the present embodiment. There is an attenuation peak 34 in a region 33 formed between the two band pass regions; a low band pass region 31 and a high band pass region 32. Also an attenuation peak 36 is formed in a vicinity region 35 located at the lower end of the low band pass region 31, and an attenuation peak 38 in a vicinity region 37 located at the higher end of the high band pass region 32. Thus a certain amount of attenuation is secured in each of regions 33, 35 and 37, or the regions other than the low band pass region 31 and the high band pass region 32.

Figure 18:
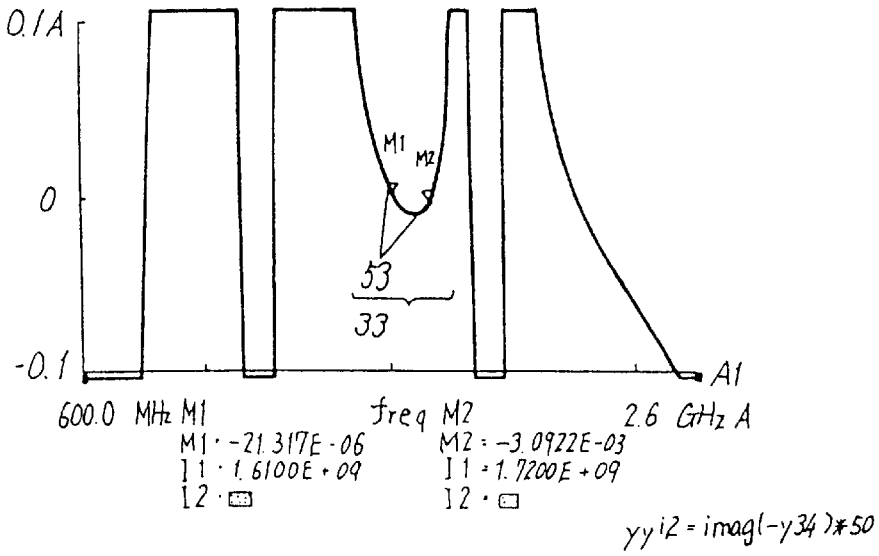
FIG. 18 is a chart used to show admittance characteristic of the multilayer filter.
Figure 19:
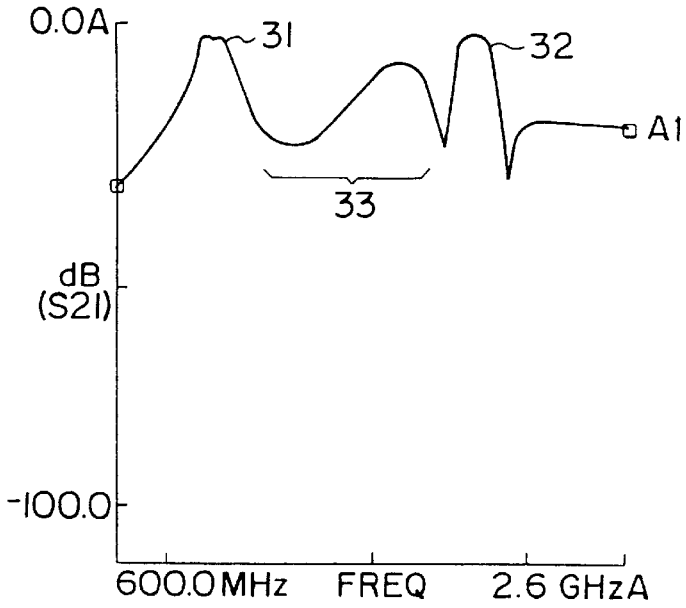
FIG. 19 PRIOR ART
FIG. 19 is a chart used to show band pass characteristic of a prior art multilayer filter.
Figure 20:
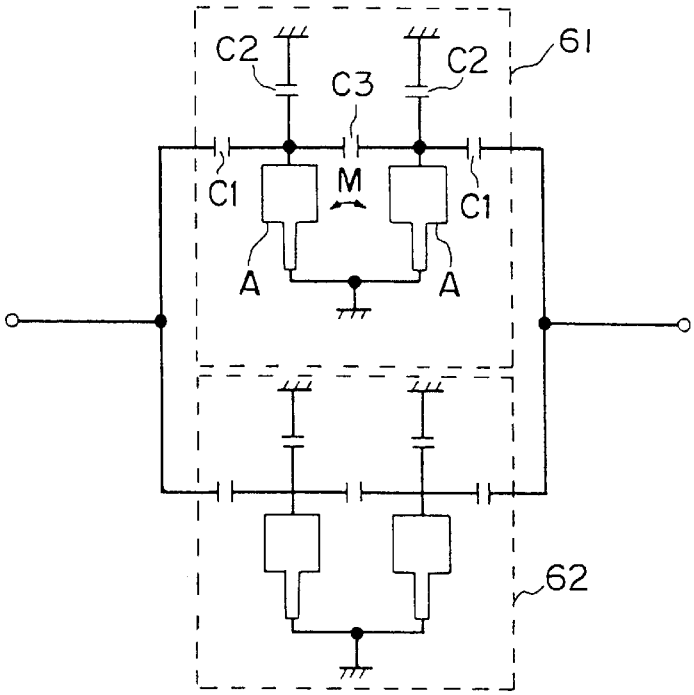
FIG. 20 PRIOR ART
FIG. 20 is an equivalent circuit diagram of the prior art multilayer filter.

The line impedance of connection pattern 43C may be made high by making the line width in a direction perpendicular to the length direction of the strip line of connection pattern 43C, which connects the grounding sector 43B of strip line 43A, 43D with the grounding electrode 50 constituting a resonator A, B, smaller than the smallest line width of strip line 43A, 43D. Therefore, an inductance L1 of FIG. 17 is formed. As shown in FIG. 18, an attenuation peak 34 may be formed by creating in the region 33 a point 53 at which the admittance shifts from the capacitive to the inductive, or a point at which the admittance becomes 0. This provides a larger amount of attenuation. A similar effect may be obtained also by shaping the grounding electrode 50 of strip line 43A, 43D to have a sector whose width is smaller than the smallest line width of the strip line 43A, 43D.

Although a multilayer filter of two band pass regions has been described in the present embodiments, a multilayer filter having a plurality of band pass regions may of course be realized in accordance with the present invention.

INDUSTRIAL APPLICABILITY

Because a great inductance component is formed among the input terminal, output terminal and the resonator in the invented filter, a high input impedance is obtained in a region of higher frequency. As a result, a filter of higher band pass region can be connected as it is without employing a phase shifter or such other external devices. This enables to reduce the overall size of a filter.

Furthermore, because a substantial amount of attenuation is ensured in a region between the band pass regions in accordance with the present invention, the signal selectivity is improved and the performance of a filter may be improved without deteriorating the insertion loss characteristics in band pass regions.

What is claimed is:

1. A multilayer filter formed of a plurality of dielectric layers stacked one on the other comprising:

a dielectric layer provided with a plurality of strip lines disposed between dielectric layers having a shield pattern;

a dielectric layer provided with an input pattern and an output pattern, a coupling sector of said input and output patterns facing to said plurality of strip lines; and an input electrode and an output electrode formed on a side surface connected with said input pattern and said output pattern respectively at their one end, wherein the dielectric constant of a region between a continuity sector of said input pattern and said output pattern and said shield pattern is lower than that of the surrounding region.

2. The multilayer filter of claim 1, wherein an empty space is provided in a region between said continuity sector and said shield pattern.

3. The multilayer filter of claim 2, wherein said empty space is filled with a dielectric substance whose dielectric constant is lower than that of the surrounding region.

* * * * *